US008657967B2

(12) United States Patent
Romera et al.

(10) Patent No.: US 8,657,967 B2
(45) Date of Patent: Feb. 25, 2014

(54) AMORPHOUS ALLOY AND PROCESS FOR PRODUCING PRODUCTS MADE THEREOF

(75) Inventors: Daniel Ruiz Romera, Zelzate (BE); Serge Claessens, Zelzate (BE); Marc De Wulf, Zelzate (BE); Nele Van Steenberge, Zelzate (BE); Joachim Antonissen, Zelzate (BE)

(73) Assignee: OCAS Onderzoekscentrum voor Aanwending van Staal N.V., Zelzate (BE)

( * ) Notice: Subject to any disclaimer, the term of this patent is extended or adjusted under 35 U.S.C. 154(b) by 462 days.

(21) Appl. No.: 12/937,872

(22) PCT Filed: Apr. 15, 2009

(86) PCT No.: PCT/EP2009/054477

§ 371 (c)(1), (2), (4) Date: Feb. 17, 2011

(87) PCT Pub. No.: WO2009/127665

PCT Pub. Date: Oct. 22, 2009

(65) Prior Publication Data

US 2011/0162759 A1 Jul. 7, 2011

(30) Foreign Application Priority Data

Apr. 15, 2008 (EP) ..... 08154579
May 8, 2008 (EP) ..... 08155922

(51) Int. Cl.
*C22B 9/16* (2006.01)
*C22C 45/02* (2006.01)
*H01F 1/153* (2006.01)

(52) U.S. Cl.
CPC . *C22B 9/16* (2013.01); *C22C 45/02* (2013.01); *H01F 1/15333* (2013.01); *C22C 2200/02* (2013.01)
USPC ..... 148/100; 148/540; 148/561

(58) Field of Classification Search
None
See application file for complete search history.

(56) References Cited

U.S. PATENT DOCUMENTS 4,437,912 A * 3/1984 Sakakima et al. ..... 148/403
5,160,379 A 11/1992 Yoshizawa et al.

(Continued)

FOREIGN PATENT DOCUMENTS

EP 0 529 634 A1 3/1993

OTHER PUBLICATIONS

R. Barrue et al.; "Influence of substitution elements on magnetic and thermal properties of amorphous $Fe_{79}$ $B_{16}$ $Si_{15}$ ribbons"; Physica Scripta, Institutes of Physics Publishing, Bristol, GB, vol. 37, Jan. 1, 1988, pp. 356-358; XP009107822; ISSN: 1402-4896.

*Primary Examiner* — George Wyszomierski
(74) *Attorney, Agent, or Firm* — Reinhart Boerner Van Deuren P.C.

(57) ABSTRACT

The present invention is related to process for producing an amorphous Fe-based bulk metallic glass product, formed of an alloy having a chemical formula of $Fe_{100-a-b-c-d-x-y}$ $M_a$N-$b_b$$Si_c$$B_d$$I_x$$J_y$ wherein: • M is Co and/or Ni, •I is one or more elements of the group consisting of Al, Cr, Cu, Mn, C and P, •J is one or more elements of the group consisting of Ti, S, N and O and wherein a, b, c, d, x and y are satisfying the following conditions: 0 wt. %<a≤46. 1 wt. %, 5.4 wt. %≤b≤12.4 wt. %, 2.2 wt. %≤c≤4.4 wt. %, 2 wt. %<d≤6 wt. %, x≤2 wt. % and y≤0.2 wt. %, the process comprising the steps of producing a master alloy by melting starting materials, comprising Fe-containing alloys, and by melting said master and pouring the molten alloy into a mold.

12 Claims, 3 Drawing Sheets

(56) References Cited

U.S. PATENT DOCUMENTS

| | | | | |
|---|---|---|---|---|
| 6,350,323 | B1 * | 2/2002 | Inoue et al. | 148/304 |
| 7,052,561 | B2 * | 5/2006 | Lu et al. | 148/403 |
| 8,277,579 | B2 * | 10/2012 | Makino | 148/304 |
| 2001/0054330 | A1 | 12/2001 | Bizen et al. | |
| 2003/0041931 | A1 | 3/2003 | Sunakawa et al. | |
| 2005/0263216 | A1 * | 12/2005 | Chin et al. | 148/304 |

* cited by examiner

AMORPHOUS ALLOY AND PROCESS FOR PRODUCING PRODUCTS MADE THEREOF

CROSS-REFERENCE TO RELATED APPLICATIONS

This patent application is the National Stage of International Application No. PCT/EP2009/054477, filed Apr. 15, 2009, that claims the benefit of European Application No. 08154579.0, filed Apr. 15, 2008, and European Application No. 08155922.1, filed May 8, 2008, the entire teachings and disclosure of which are incorporated herein by reference thereto.

FIELD OF THE INVENTION

The present invention is related to products produced from Fe-based amorphous alloys (also called bulk metallic glass), and to the application of such products, in particular as magnetic cores.

STATE OF THE ART

The production of Fe-based bulk metallic glass (BMG) is difficult due to the low glass forming ability shown by known Fe-alloys used for this purpose, in comparison for example to Zr-based alloys. For this reason, a large number of elements are usually added to Fe in order to produce Fe-based BMG's. With 'bulk' we refer to three-dimensional bodies, obtained by casting in a mould, wherein the smallest dimension, i.e. the thickness or the diameter, is at least 0.3 mm, preferably at least 0.5 mm.

Besides the need for a large number of elements (minimum 4), the number of impurities must be carefully controlled in order to avoid crystallization by heterogeneous nucleation during casting. This demands the use of very pure base elements which are in fact very expensive making the current production processes of Fe-based BMG's very costly. Some impurities can cause in addition a decrease in the final aimed properties; therefore their levels must be carefully controlled. Fe-based amorphous materials generally have good soft magnetic properties, i.e. coercivity is very low and permeability shows large values. The FeNbBSi-alloy is a known example in terms of these characteristics. It is known in the art to fabricate ribbons of these compositions and also to apply such ribbons for making magnetic cores. The ribbons (20 μm) are wound to form a ring-shaped product. Other techniques involve the cutting of "thick" ribbons (up to 50 μm) with a ring-shape and the stacking of them in order to form the thick ring-core. All these steps make the production of such magnetic cores more expensive.

Also, some bulk metallic glass products, such as products obtained from sintered powders, are not suitable for low frequency (e.g. 50 Hz or 60 Hz) applications. There is currently no soft magnetic amorphous Fe-based material having a thickness higher than 500 μm with a high level of impurities (industrial ferroalloys used) and suitable for soft magnetic applications.

AIMS OF THE INVENTION

The present invention aims to provide an amorphous Fe-based alloy and a process for producing products made thereof, said alloy and products being producible from industrial base materials, whilst yielding an end product with soft magnetic properties and being suitable for low frequency applications.

SUMMARY OF THE INVENTION

The present invention is related to a process for producing an amorphous Fe-based bulk metallic glass product, formed of an alloy having a chemical formula of $Fe_{100-a-b-c-d-x-y}M_aNb_bSi_cB_dI_xJ_y$ wherein:

M is Co and/or Ni,

I is one or more elements of the group consisting of Al, Cr, Cu, Mn, C and P,

J is one or more elements of the group consisting of Ti, S, N and O and wherein a, b, c, d, x and y are satisfying the following conditions: 0 wt. %≤a≤46.1 wt. %, 5.4 wt. %≤b≤12.4 wt. %, 2.2 wt. %≤c≤4.4 wt. %, 2 wt. %≤d≤6 wt. %, x≤2 wt. % and y≤0.2 wt. %, the process comprising the steps of:

Providing starting materials, comprising Fe-containing alloys,

Melting said starting materials at a temperature above the melting temperature of said materials, Keeping the materials in a molten state, Pouring the molten materials into a mould, Cooling the molten material, to obtain a master alloy, Introducing the master alloy in a melting device, Heating up the master alloy to a temperature above its melting temperature, Pouring the molten material into a mould, Cooling the molten material, to obtain the product.

According to an embodiment, the master alloy is heated to a temperature of at least 50° C. higher than its melting temperature, more preferably at least 75° C. higher than said melting temperature.

Said starting materials may comprise or consist of the following: electrolytic Fe, AK-steel, FeB, FeSi, FeNb. They may further comprise or consist of electrolytic Fe, AK-steel, FeB, FeSi, FeNb and pure Co.

The composition of these starting materials is preferably defined by the values given in claim 3.

The melting steps for melting the starting materials and/or the melting steps for melting the master alloy may be performed in a levitation melter or in an induction melting device. The induction device may be a device as shown in FIG. 4. The process for producing the master alloy and/or the process for producing the final product from the master alloy may include a step of creating a vacuum in a melting chamber, said melting taking place under a protective atmosphere, e.g. Ar. The protective atmosphere is introduced into the chamber after creation of the vacuum. Said vacuum may be defined by a pressure of at least $10^{-1}$ bar, more preferably at least $10^{-2}$ bar.

The invention is equally related to a product produced according to the process of the invention, wherein 0.05≤x≤2 wt % and 0.01≤y≤0.2 wt %. More preferably, x≤1 wt % and/or y≤0.1 wt %.

A master alloy produced according to the process of the invention, preferably has an O-level lower than or equal to 0.05 wt %.

A product produced according to the invention is a bulk metallic product. It may be a ring core for a differential switchgear, said ring core having a thickness higher than 300 μm, preferably higher than 500 μm.

The product preferably has magnetic properties defined by:

coercivity between 0.5 A/m and 10 A/m, and relative magnetic permeability between 50000 and 500000.

DETAILED DESCRIPTION OF THE INVENTION

Figure 1:
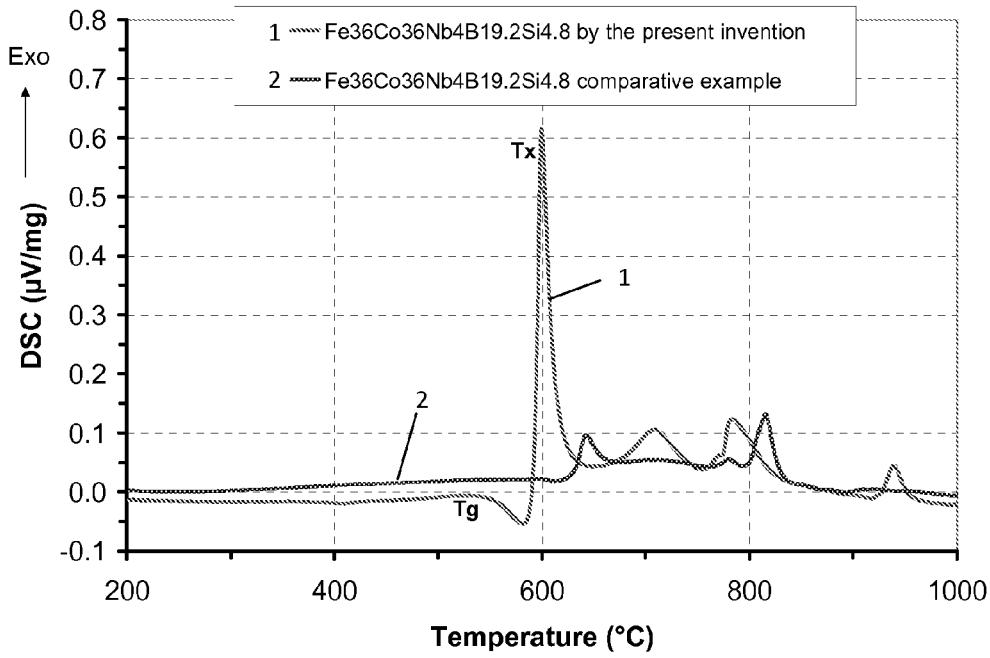
FIG. 1 illustrates the DSC of an amorphous rod (2 mm) $Fe_{42.2}Co_{43.2}Nb_{6.93}B_{4.19}Si_{2.9}I_{0.50}J_{0.06}$ (wt %) ($Fe_{36.53}Co_{35.32}Nb_{3.30}B_{18.64}Si_{5.24}I_{0.90}J_{0.07}$ (at %), nominal composition being $Fe_{36}Co_{36}Nb_4B_{19.2}Si_{4.8}$), produced with raw Fe-alloys and following the present invention (curve 1). As a comparison an example of the same nominal composition but not amorphous is shown (curve 2). In the latter example, the O-content in the master alloys exceeded the recommended limit, O>0.03 wt. % ppm.

The invention is related to an amorphous Fe-alloy having the chemical formula of $Fe_{100-a-b-c-d-x-y}M_aNb\ Si_cB_dI_xJ_y$ wherein:

M is Co and/or Ni,

I is one or more elements of the group consisting of Al, Cr, Cu, Mn, C and P,

J is one or more elements of the group consisting of Ti, S, N and O and wherein a, b, c, d, x and y are satisfying the following conditions: 0 wt. %≤a≤46.1 wt. %, 5.4 wt. %≤b≤12.4 wt. %, 2.2 wt. %≤c≤4.4 wt. %, 2 wt. %≤d≤6 wt. %, x≤2 wt. % and y≤0.2 wt. %.

Alternatively, when the ranges of M, Nb, Si and B are expressed in at. %, a, b, c, d, are satisfying the following conditions: 0 at. %≤a≤36 at. %, 3 at. %≤b≤6 at. %, 4 at. %≤c≤7 at. %, 10 at. %≤d≤25 at. %, with x≤1.8 at. % and y≤0.15 at. %.

According to a preferred embodiment, 0.05≤x≤2 wt. % and 0.01≤y≤0.2 wt. %. According to another embodiment, x≤1 wt. % and/or y≤0.1 wt. %. According to a further embodiment, 0.05≤x≤1 wt. %. When M is both Co and Ni, the formula should be interpreted as $Fe_{100-a-b-c-d-x-y}CO_{a'}Ni_{a''}Nb_bSi_cB_dI_xJ_y$ with a'+a"=a. When the alloy comprises oxygen, the O-content is preferably lower than or equal to 0.05 wt %.

The invention is related to a process for producing an amorphous Fe-based bulk metallic glass (BMG) product, i.e. a bulk amorphous metal product having a composition according to the alloy of the invention, and obtained by casting in a mould, to obtain a product with a thickness of at least 0.3 mm, preferably at least 0.5 mm. In a first series of steps, a master alloy is produced. The process of the invention starts from starting materials which comprise Fe-containing alloys, i.e. non-pure materials. The starting materials may comprise raw Fe-alloys used in the steel industry. These materials are introduced into a melting device, and heated up to a temperature higher than their melting temperature, preferably between 1300° C. and 1600° C. In the case for example of the $Fe_{36}CO_{36}Nb_4B_{19.2}Si_{4.8}$ composition it is preferred to have a temperature higher than 1350° C. The melting can be done under air or under a protective atmosphere, e.g. Ar. The use of a controlled atmosphere with low oxygen level can favour the cleanness of the resulting product (i.e. a low level of impurities and oxygen). According to a preferred embodiment, the atmosphere is controlled by creating a vacuum in the melting chamber. In this case, before melting, a vacuum of at least $10^{-1}$ bar, preferably at least $10^{-2}$ bar, is created inside the chamber in order to get a clean atmosphere. Subsequently, during melting, a protective Ar-atmosphere can be used, for example at a pressure of 1 bar.

The material is kept in a molten state during a period of time, preferably between 100 s and 300 s, to promote homogenization (especially important for the dissolution of FeB). Then the molten material is cast into a mould, preferably a Cu-mould, and cooled down to form the master alloy.

According to a preferred embodiment, the starting materials are at least the following: electrolytic-Fe, AK-steel (Al-killed steel), FeB, FeSi, FeNb and preferably also pure Co. The alloys FeB, FeSi and FeNb are materials used by the steel industry, which may comprise other elements than expressed by the alloy formula.

In the context of this invention, the composition of the starting materials is defined by the limits expressed in table 1 (all values in wt %).

TABLE 1

| | composition of starting materials | | | | | |
|---|---|---|---|---|---|---|
| | Electrolytic-Fe | Ak-steel | FeB | FeSi | FeNb | Pure Co |
| C | 0.0005-0.1 | 0.0005-0.1 | 0.01-0.5 | 0.001-0.3 | 0.001-0.3 | — |
| Mn | 0.0001-0.2 | 0.001-0.5 | 0.01-2 | 0.01-1 | 0.01-1 | — |
| Si | 0.0001-0.1 | 0.0001-0.3 | 0.01-2 | 62-75 | 0.2-3 | — |
| P | 0.0005-0.03 | 0.0005-0.1 | 0.0005-0.1 | 0.0005-0.1 | 0.0005-0.1 | — |
| S | 0.0001-0.05 | 0.0005-0.01 | 0.0005-0.1 | 0.0005-0.1 | 0.0005-0.2 | — |
| Al | 0.0001-0.2 | 0.0001-0.4 | 0.001-0.8 | 0.001-0.8 | 0.001-1.2 | — |
| Ti | 0.0001-0.1 | 0.0001-0.1 | 0.0001-1 | 0.0001-1 | 0.0001-1 | — |
| Nb | 0.0001-0.1 | 0.0001-0.1 | 0.0001-0.1 | 0.0001-0.1 | 60-74 | — |
| Cu | 0.0001-0.08 | 0.001-0.1 | 0.001-0.3 | 0.001-0.1 | 0.001-0.3 | — |
| Cr | 0.0001-0.08 | 0.001-0.1 | 0.001-0.5 | 0.001-0.1 | 0.001-0.1 | — |
| Ni | 0.0001-0.08 | 0.001-0.1 | 0.001-0.3 | 0.001-0.1 | 0.001-0.1 | — |
| As | 0.0001-0.02 | 0.0001-0.05 | 0.0001-0.1 | 0.0001-0.05 | 0.0001-0.05 | — |
| Sn | 0.0001-0.02 | 0.0001-0.05 | 0.0001-0.1 | 0.0001-0.05 | 0.0001-0.05 | — |
| O | 0.001-0.1 | 0.0005-0.1 | 0.002-0.1 | 0.001-0.05 | 0.001-0.05 | — |
| N | 0.0003-0.01 | 0.0005-0.02 | 0.0005-0.05 | 0.0005-0.02 | 0.0005-0.02 | — |
| B | 0.0001-0.001 | 0.0001-0.001 | 15-21 | 0.0001-0.001 | 0.0001-0.001 | — |
| Mo | 0.0001-0.05 | 0.001-0.1 | 0.001-0.3 | 0.001-0.1 | 0.001-0.1 | — |

TABLE 1-continued

| composition of starting materials | | | | | | |
|---|---|---|---|---|---|---|
| | Electrolytic-Fe | Ak-steel | FeB | FeSi | FeNb | Pure Co |
| Zr | 0.001-0.05 | 0.001-0.08 | 0.001-0.2 | 0.001-0.1 | 0.001-0.1 | — |
| V | 0.0001-0.1 | 0.0001-0.1 | 0.0001-0.5 | 0.0001-0.3 | 0.0001-0.3 | — |
| Co | 0.0001-0.1 | 0.0001-0.1 | 0.0001-0.1 | 0.0001-0.1 | 0.0001-0.1 | 99.5-99.95 |
| Fe | Rest | Rest | 78.3 | 22.9 | 28.9 | — |

The total amount of impurities in the Fe-alloys used as starting materials for the production of soft magnetic bulk according to the invention is preferably lower than 4% and more preferably lower than 2%. With impurities is meant the elements that are not nominally present in the alloy. For example, Nb is an impurity in FeB. Moreover, the amount of Mn in the Fe-alloys (starting materials) is preferably lower than 2% and more preferably lower than 1%.

The melting step can be performed in a levitation melter, e.g. a 100 cc levitation melter. A levitation melter is a cold crucible induction melter. It consists of a copper crucible cooled by a circulation of water and a coil system creating a varying magnetic field. This magnetic field creates Foucault currents in the conductive materials inside the crucible which have three effects: heating the metals in the crucible up to their melting point, stirring the molten alloy, thus homogenising it, and making the molten mass levitate. During levitation melting, there is no contact between the molten alloy and the crucible, which can remain cold while the melt can stay clean. Other melting devices may be used, e.g. an induction melting device, of which an example is described further (in relation to FIG. 4).

When a levitation melter of 100 kW power is used for producing the master alloy, it is preferred to melt the materials at a power of at least 25% of the total power and preferably in the range 25-50% of the total power. When the melting takes place under protective atmosphere, the pressure in the melting chamber is preferably at least 1 atm.

It is important to have in the master alloy an O-level lower than 0.05 wt. % and it is preferred that this level is lower than 0.03 wt. %.

For a good magnetic performance, some impurities must not exceed certain values in the master alloy: Ti, S and N. The total amount of (Ti+S+N) must be lower than 0.2% and preferably lower than 0.1%. On the other hand, other impurities might reach higher values, being beneficial for the glass forming ability. This is the case of Al, Ni, Cr, Cu, Mn, C and P. However, when a certain value is exceeded, the properties of the material can be damaged. This value can be fixed to 2% and preferably to 1%.

The further steps of producing the bulk metallic glass product from the master alloy can be done in a melting device, like an induction melting device or a levitation melting device. An air atmosphere can be used although a controlled atmosphere or an atmosphere with low oxygen levels is preferable. Again, this can be obtained by applying a vacuum, followed by the introduction of the protective atmosphere, e.g. Ar, into a reactor chamber. The BMG can be cast in rods with a thickness of up to 4 mm, but also in other shapes, like ring-cores.

The process to form the BMG-product from the master alloy preferably comprises the following steps:

A piece of master alloy is introduced in the melting device. The melting device can be a levitation melter of 12 kW. An air atmosphere can be used although it is preferable to use of a controlled atmosphere like for example an Ar-atmosphere.

Heating up the master alloy up to a heating temperature higher than its melting temperature. This melting temperature is in the case of $Fe_{36}CO_{36}Nb_4B_{19.2}Si_{4.8}$ alloy around 1250° C. When a 12 kW levitation melter is used, a minimum power of 50% must be used and preferably a power of at least 60% should be used. The material must be molten for at least 5 seconds and preferably during a time longer than 10 seconds. The heating up to the melting temperature can be done with only one ramp, but it can be preferably done in several heating steps. For example when a 12 kW levitation melter is used, the following heating cycle can be used: 5 seconds at 20% of the power, 5 seconds at 35% of the power, 5 seconds at 50% of the power and 2 seconds at 60% of the total power.

Pouring the material into a Cu-mould at a casting temperature higher than the melting temperature, but preferably not exceeding by more than 20° C. the melting temperature when the aimed diameter is between 2 and 3 mm. It is preferred to pour the material at a "low" temperature in order to prevent crystallization. In the preferred case, the heating temperature is equal to the casting temperature.

Cooling the molten material, to obtain the product.

Figure 4:
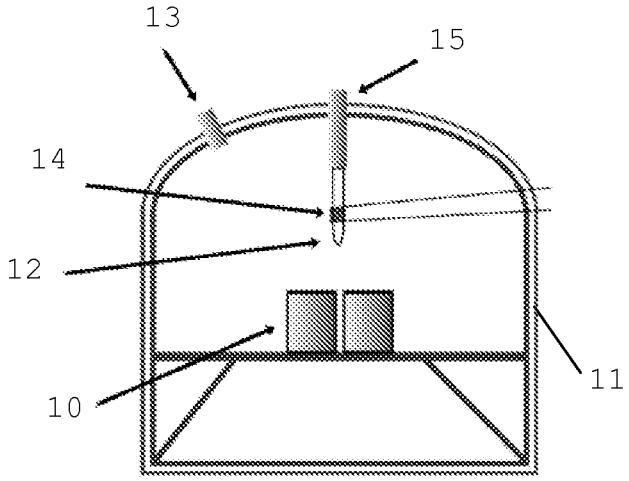
FIG. 4 shows a test setup for melting a master alloy and producing a bulk metallic glass rod in an induction heating device.

According to an embodiment, the master alloy is heated up to a temperature Th of at least 50° C. higher than its melting temperature, more preferably at least 75° C. higher than said melting temperature (melting temperature being the melting point of the solid master alloy, i.e. the temperature at which the master alloy begins to become liquid under atmospheric pressure). It has been found that the application of this range of heating temperature may lead to improved values of coercivity of the final product. A preferred way of obtaining these results is by using an induction heater, as shown in FIG. 4. The Cu-mould 10 is placed inside reactor 11. The master alloy is introduced into tube 12 made of quartz. A vacuum connection 13 is present, for creating a vacuum in the reactor. Through the same connection or a different connection (not shown), a protective atmosphere can then be introduced, e.g. Ar, before starting the melting process. Alternatively, the melting process can be performed under air atmosphere. The tube is heated to the temperature Th referred to above, by applying a current to induction coil 14. The tube has a small opening (nozzle) in the bottom. When the master alloy has become liquid, it is poured through the nozzle into the Cu-mould where it cools down to form the final BMG product. The casting temperature is thus equal to the heating temperature in this case. A further connection 15 is present in order to introduce an overpressure in the tube (measured with respect to the pressure inside the reactor, e.g. air or Ar) above the molten master alloy, said overpressure assisting in the fast pouring of the molten material into the mould.

Figure 5:
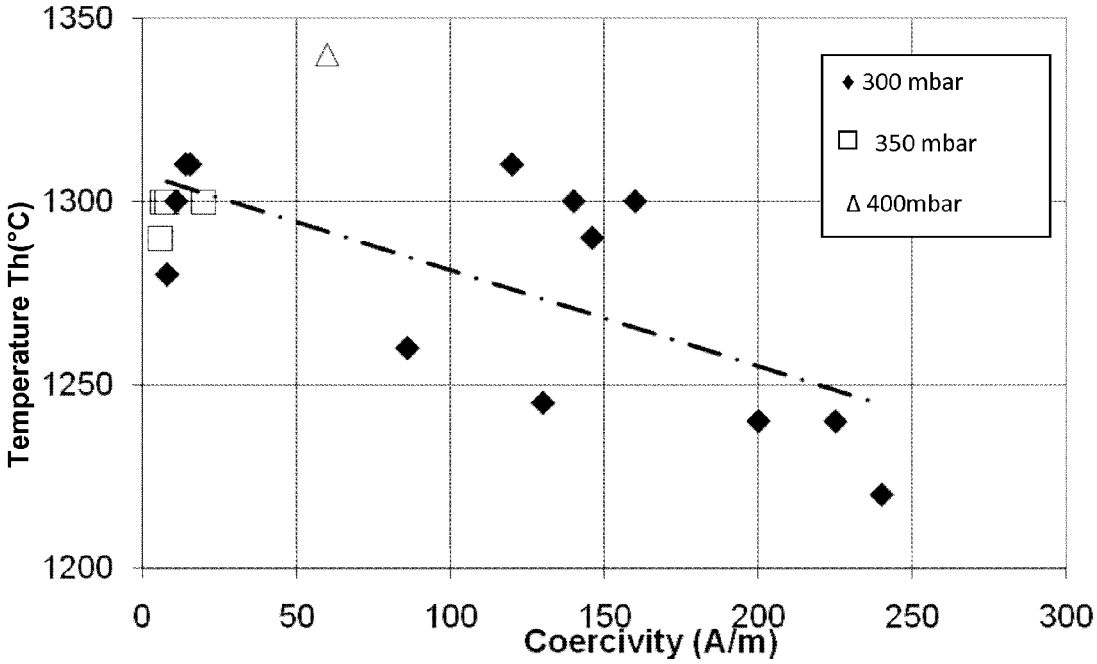
FIG. 5 shows test results obtained with the setup of FIG. 4.

Measurements of coercivity of thus produced products in relation to the casting temperature Th are shown in FIG. 5, for three values of the overpressure (the pressure inside the reactor was around 300 mbar). For the master alloys used in this test, melting temperatures were approximately 1200° C., so it is clear from the results that higher casting temperatures, preferably at least 50° C. above the melting point, may lead to lower values of coercivity, i.e. better magnetic properties.

The invention is thus related to any product, produced by the process of the invention, and in particular to a bulk metallic glass product, formed of the alloy used in the process. With 'bulk metallic glass product' is meant a product with the smallest dimension (e.g. thickness in case of a cylinder-like rod) of at least 300 μm, preferably at least 500 μm, more preferably at least 1 mm, obtained by casting in a mould. According to a preferred embodiment of such a product, a ring-core for a differential switchgear is provided. The thickness of said ring core is at least 300 μm, preferably at least 500 μm, more preferably at least 1 mm. The properties of a product according to the invention, such as a ring core are:

coercivity between 0.5 A/m and 10 A/m, and relative magnetic permeability between 50000 and 500000.

The ring cores according to the invention are suitable for low frequency applications (50 Hz or 60 Hz).

Examples

Test Results

The following table 2 gives an example of the composition of starting materials used in the process of the invention (in wt. %).

TABLE 2

| | Electrolytic-Fe | Ak-steel | FeB | FeSi | FeNb | Pure Co |
|---|---|---|---|---|---|---|
| C | 0.0013 | 0.0010 | 0.2 | 0.008 | 0.017 | — |
| Mn | 0.0001 | 0.0500 | 0.48 | 0.063 | 0.21 | — |
| Si | 0.0005 | — | 1.10 | 66.9 | 1.83 | — |
| P | 0.0010 | 0.0030 | 0.001 | 0.001 | 0.10 | — |
| S | 0.0001 | 0.0030 | 0.001 | 0.001 | 0.042 | — |
| Al | 0.0001 | 0.0030 | 0.10 | 0.025 | 0.60 | — |
| Ti | — | — | 0.026 | 0.073 | 0.35 | — |
| Nb | — | — | — | — | 63.3 | — |
| Cu | 0.0005 | 0.0080 | 0.11 | 0.004 | 0.04 | — |
| Cr | 0.0001 | 0.0150 | 0.19 | 0.009 | 0.02 | — |
| Ni | 0.0002 | 0.0100 | 0.12 | 0.007 | 0.01 | — |
| As | 0.0001 | — | — | — | — | — |
| Sn | 0.0001 | — | — | — | — | — |
| O | 0.0245 | 0.0050 | 0.0220 | 0.029 | 0.074 | — |
| N | 0.0008 | 0.0028 | 0.005 | 0.004 | 0.004 | — |
| B | 0.0001 | — | 18.6 | — | — | — |
| Mo | — | 0.0010 | — | — | — | — |
| Zr | — | — | — | — | — | — |
| V | — | — | — | — | — | — |
| Co | — | — | — | — | — | 99.9 |
| Fe | Rest | Rest | 78.3 | 22.9 | 28.9 | — |

The amorphicity of the obtained materials can be tested by means of different techniques. DSC (differential scanning calorimetry) and XRD are two known examples. Differential scanning calorimetry gives the evolution of heat capacity of a sample when it is heated. The sample is heated along with a reference (an empty crucible) so that both always have similar temperatures, controlled with accuracy. The difference between the energies brought to the sample and reference to heat them up at the same rate is monitored and gives the difference of behaviour. Endothermic and exothermic transformations in the sample can be spotted because they happen when respectively more or less energy must be brought to it to keep the same heating rate. So changes in heat capacity indicate phase transitions such as crystallisation or even simple transformations like glass transition.

FIG. 1 gives the DSC of an $Fe_{42.2}Co_{43.2}Nb_{6.93}B_{4.19}Si_{2.9}I_{0.50}J_{0.06}$ alloy (wt %) ($Fe_{36.53}Co_{35.32}Nb_{3.30}B_{18.64}Si_{5.24}I_{0.90}J_{0.07}$ (at %), nominal composition being $Fe_{36}CO_{36}Nb_4B_{19.2}Si_{4.8}$), produced according to the process of the invention. A glass transition and a first crystallization peak are clearly visible on the figure (curve 1). On the other hand, the curve 2 on the DSC curve has no visible glass transition and a very slight crystallisation peak at around 600. This means that the sample is not fully amorphous and contains only a very small amount of amorphous phase. During the production of this comparison example (curve 2), it was detected that the oxygen of the master alloy was over the recommended limits, being higher than 0.03 wt. %. For this reason it was not possible to produce a bulk metallic glass.

Figure 2:
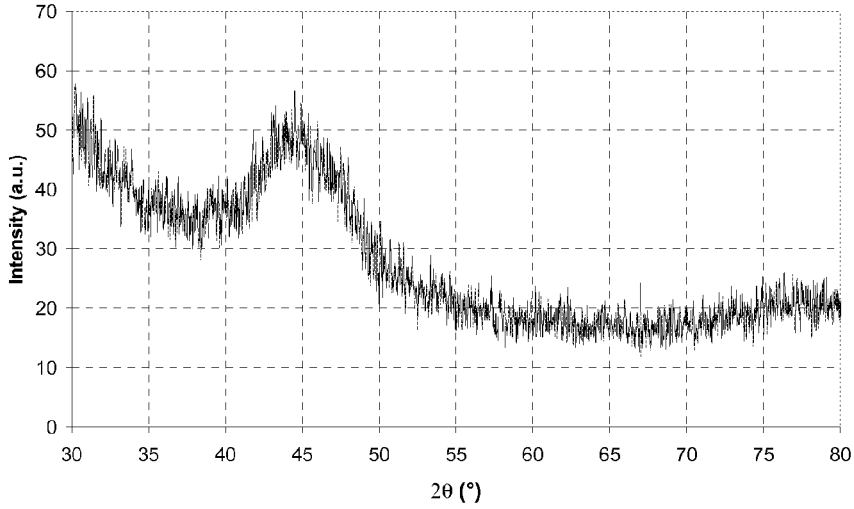
FIG. 2 shows the XRD spectrum of an amorphous rod (2 mm) of $Fe_{42.2}CO_{43.2}Nb_{6.93}B_{4.19}Si_{2.9}I_{0.50}J_{0.06}$ (wt %) ($Fe_{36.53}Co_{35.32}Nb_{3.30}B_{18.64}Si_{5.24}I_{0.90}J_{0.07}$ (at %), nominal composition being $Fe_{36}Co_{36}Nb_4B_{19.2}Si_{4.8}$), produced with raw Fe-alloys according to the present invention.

Like all amorphous materials (e.g. polymers, silica-based glasses) and unlike crystalline material, bulk metallic glass shows no peak of diffraction on an X-ray diffractogram but a broad halo. This is due to the lack of long-range order and crystallinity and to the presence of short range order. The X-ray diffraction diagram of an amorphous sample with chemical composition $Fe_{42.2}CO_{43.2}Nb_{6.93}B_{4.19}Si_{2.9}I_{0.50}J_{0.06}$ (wt %) ($Fe_{36.53}Co_{35.32}Nb_{3.30}B_{18.64}Si_{5.24}I_{0.90}J_{0.07}$ (at %)), produced according to the present invention is shown by FIG. 2, where no Bragg peaks can be noticed, meaning that the sample is essentially amorphous.

Figure 3:
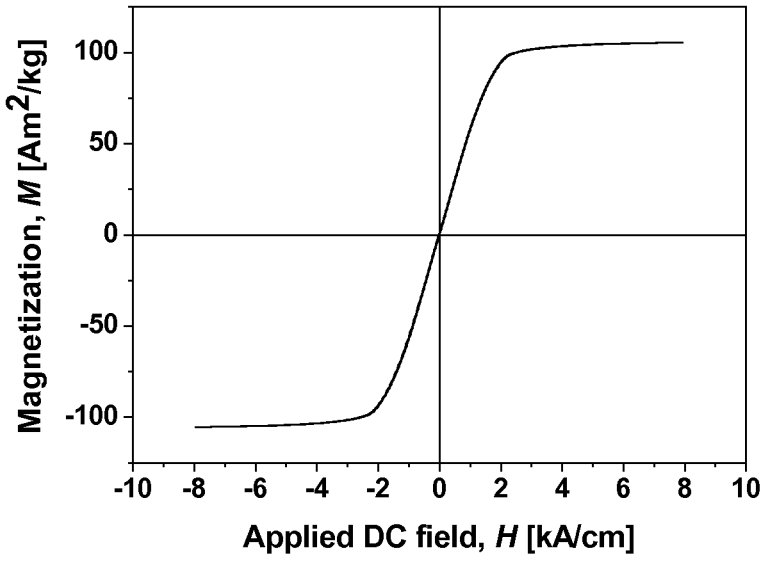
FIG. 3 shows the B-H loop of a $Fe_{36}CO_{36}Nb_4B_{19.2}Si_{4.8}$ amorphous rod of 2 mm diameter.

The magnetic properties of the materials produced according to the present invention have been tested, see FIG. 3. FIG. 3 shows the B-H loop of $Fe_{42.2}CO_{43.2}Nb_{6.93}B_{4.19}Si_{2.9}I_{0.50}J_{0.06}$ (wt %) ($Fe_{36.53}CO_{35.32}Nb_{3.30}B_{18.64}Si_{5.24}I_{0.90}J_{0.07}$ (at %)), as measured by means of a Vibrating Sample Magnetometer (VSM). A saturation magnetization of 1.04 T is measured together with a coercivity of 4.5 A/m.

A hysteresis loop tracer was used to measure systematically the coercivity of the bulk metallic glass products produced according to the present invention. Table 3 presents the results corresponding to two materials from the present invention and two comparative examples. The measurements were performed on 2 mm diameter rods of as-cast materials; no additional annealing treatments have been performed. The bulk metallic glasses show very low values of coercivity, making these materials very suitable for soft magnetic applications. On the other hand, when the material is only partially amorphous the coercivity reaches very high values. In this comparative example, the O-content of the master alloy exceeded the limits of the present invention (>0.03 wt. %). For this reason it was not feasible to produce a bulk metallic glass with such master alloy. The second comparative example corresponds to a bulk metallic glass product of the same composition but prepared with pure elements. The amorphous materials produced by the present invention, i.e. starting with standard Fe-alloys have magnetic properties similar to those of bulk metallic glass produced with high-purity elements.

TABLE 3

Coercivity measurements on $Fe_{36}Co_{36}Nb_4B_{19.2}Si_{4.8}$ (nominal composition (at %))

| | Base materials | State | Coercivity (A/m) |
|---|---|---|---|
| Present invention 1 | Industrial Fe-alloys | Amorphous | 8 |
| Present invention 2 | Industrial Fe-alloys | Amorphous | 5 |
| Comparative example 1 | Industrial Fe-alloys | Partially amorphous | 7000 |
| Comparative example 2 | Pure elements | Amorphous | 4.5 |

The invention claimed is:

1. A process for producing an amorphous Fe-based bulk metallic glass product, formed of an alloy having a chemical formula of Fe100-a-b-c-d-x-y MaNbbSicBdlxJy wherein:

M is Co and/or Ni,

I is one or more elements of the group consisting of Al, Cr, Cu, Mn, C and P,

J is one or more elements of the group consisting of Ti, S, N and O and wherein a, b, c, d, x and y are satisfying the following conditions: 0 wt. %≤a≤46.1 wt. %, 5.4 wt. %≤b≤12.4 wt. %, 2.2 wt. %≤c≤4.4 wt. %, 2 wt. %≤d≤6 wt. %, x<2 wt. % and y<0.2 wt. %, the process comprising the steps of:

Providing starting materials, comprising Fe-containing alloys,

Melting said starting materials at a temperature above the melting temperature of said materials, Keeping the materials in a molten state, Pouring the molten materials into a mould, Cooling the molten material, to obtain a master alloy, Introducing the master alloy in a melting device, Heating up the master alloy to a temperature above its melting temperature to obtain a molten material, Pouring the molten material into a mould, Cooling the molten material, to obtain the product.

2. The process according to claim 1, wherein the master alloy is heated to a temperature of at least 50° C. higher than its melting temperature.

3. The process according to claim 1, wherein said starting materials comprise the following: electrolytic Fe, Aluminum-killed steel, FeB, FeSi, FeNb.

4. The process according to claim 3, wherein the starting materials further comprise pure Co.

5. The process according to claim 3, wherein said starting materials are defined by the following compositions (in wt %):

| | Electrolytic-Fe | Aluminum-killed steel | FeB | FeSi | FeNb | Pure Co |
|---|---|---|---|---|---|---|
| C | 0.0005-0.1 | 0.0005-0.1 | 0.01-0.5 | 0.001-0.3 | 0.001-0.3 | — |
| Mn | 0.0001-0.2 | 0.001-0.5 | 0.01-2 | 0.01-1 | 0.01-1 | — |
| Si | 0.0001-0.1 | 0.0001-0.3 | 0.01-2 | 62-75 | 0.2-3 | — |
| P | 0.0005-0.03 | 0.0005-0.1 | 0.0005-0.1 | 0.0005-0.1 | 0.0005-0.1 | — |
| S | 0.0001-0.05 | 0.0005-0.01 | 0.0005-0.1 | 0.0005-0.1 | 0.0005-0.2 | — |
| Al | 0.0001-0.2 | 0.0001-0.4 | 0.001-0.8 | 0.001-0.8 | 0.001-1.2 | — |
| Ti | 0.0001-0.1 | 0.0001-0.1 | 0.0001-1 | 0.0001-1 | 0.0001-1 | — |
| Nb | 0.0001-0.1 | 0.0001-0.1 | 0.0001-0.1 | 0.0001-0.1 | 60-74 | — |
| Cu | 0.0001-0.08 | 0.001-0.1 | 0.001-0.3 | 0.001-0.1 | 0.001-0.3 | — |
| Cr | 0.0001-0.08 | 0.001-0.1 | 0.001-0.5 | 0.001-0.1 | 0.001-0.1 | — |
| Ni | 0.0001-0.08 | 0.001-0.1 | 0.001-0.3 | 0.001-0.1 | 0.001-0.1 | — |
| As | 0.0001-0.02 | 0.0001-0.05 | 0.0001-0.1 | 0.0001-0.05 | 0.0001-0.05 | — |
| Sn | 0.0001-0.02 | 0.0001-0.05 | 0.0001-0.1 | 0.0001-0.05 | 0.0001-0.05 | — |
| O | 0.001-0.1 | 0.0005-0.1 | 0.002-0.1 | 0.001-0.05 | 0.001-0.05 | — |
| N | 0.0003-0.01 | 0.0005-0.02 | 0.0005-0.05 | 0.0005-0.02 | 0.0005-0.02 | — |
| B | 0.0001-0.001 | 0.0001-0.001 | 15-21 | 0.0001-0.001 | 0.0001-0.001 | — |
| Mo | 0.0001-0.05 | 0.001-0.1 | 0.001-0.3 | 0.001-0.1 | 0.001-0.1 | — |
| Zr | 0.001-0.05 | 0.001-0.08 | 0.001-0.2 | 0.001-0.1 | 0.001-0.1 | — |
| V | 0.0001-0.1 | 0.0001-0.1 | 0.0001-0.5 | 0.0001-0.3 | 0.0001-0.3 | — |
| Co | 0.0001-0.1 | 0.0001-0.1 | 0.0001-0.1 | 0.0001-0.1 | 0.0001-0.1 | 99.5-99.95 |
| Fe | Rest | Rest | 78.3 | 22.9 | 28.9 | — |

6. The process according to claim 1, wherein said melting steps of the starting materials and/or the master alloy are performed in a levitation melter.

7. The process according to claim 1, wherein said melting steps of the starting materials and/or the master alloy are performed in an induction melting device.

8. The process according to claim 1, wherein the process for producing the master alloy and/or the process for producing the final product includes a step of creating a vacuum in a melting chamber and wherein said melting takes place under a protective atmosphere.

9. The process according to claim 8, wherein said vacuum is defined by a pressure lower than or equal to $10^{-1}$ bar.

10. The process of claim 1, wherein the product is produced, wherein 0.05≤x≤2 wt. % and 0.01≤y≤0.2 wt. %.

11. The process according to claim 10, wherein said product has magnetic properties defined by coercivity between 0.5 A/m and 10 A/m, and relative magnetic permeability between 50000 and 500000.

12. The process of claim 1, wherein the product is produced, wherein x≤1 wt. % and/or y≤0.1 wt. %.

* * * * *